US010988900B2

(12) United States Patent
Lee et al.

(10) Patent No.: US 10,988,900 B2
(45) **Date of Patent: *Apr. 27, 2021**

(54) TISSUE COMPRISING A SOFTENING COMPOSITION

(71) Applicant: Kimberly-Clark Worldwide, Inc., Neenah, WI (US)

(72) Inventors: SangGil Lee, Seoul (KR); EunSeok Yeom, Namyangju-si (KR)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 125 days.

This patent is subject to a terminal disclaimer.

(21) Appl. No.: 16/084,281

(22) PCT Filed: Mar. 21, 2017

(86) PCT No.: PCT/US2017/023323

§ 371 (c)(1),
(2) Date: Sep. 12, 2018

(87) PCT Pub. No.: WO2017/165357

PCT Pub. Date: Sep. 28, 2017

(65) Prior Publication Data

US 2019/0071822 A1 Mar. 7, 2019

Related U.S. Application Data

(60) Provisional application No. 62/313,058, filed on Mar. 24, 2016.

(51) Int. Cl.

| | |
|---|---|
| ***D21H 21/14*** | (2006.01) |
| ***D21H 17/53*** | (2006.01) |
| ***D21H 17/07*** | (2006.01) |
| ***D21H 21/24*** | (2006.01) |
| ***D21H 21/22*** | (2006.01) |
| ***D21H 19/84*** | (2006.01) |
| ***D21H 19/24*** | (2006.01) |
| ***D21H 17/06*** | (2006.01) |
| ***D21H 17/59*** | (2006.01) |
| ***D21H 19/12*** | (2006.01) |
| ***D21H 27/00*** | (2006.01) |
| ***D21H 17/36*** | (2006.01) |
| ***D21H 27/30*** | (2006.01) |

(52) U.S. Cl.

CPC ..... *D21H 21/14* (2013.01); *D21H 17/06* (2013.01); *D21H 17/07* (2013.01); *D21H 17/36* (2013.01); *D21H 17/53* (2013.01); *D21H 17/59* (2013.01); *D21H 19/12* (2013.01); *D21H 19/24* (2013.01); *D21H 19/84* (2013.01); *D21H 21/22* (2013.01); *D21H 21/24* (2013.01); *D21H 27/00* (2013.01); *D21H 27/002* (2013.01); *D21H 27/005* (2013.01); *D21H 27/30* (2013.01)

(58) Field of Classification Search

CPC ..... D21H 27/002; D21H 17/53; D21H 21/14; D21H 27/00; D21H 17/06; D21H 17/07; D21H 17/36; D21H 19/24; D21H 19/84; D21H 23/22; D21H 27/004; A47K 10/16

See application file for complete search history.

(56) References Cited

U.S. PATENT DOCUMENTS

| | | | | |
|---|---|---|---|---|
| 5,200,036 | A | 4/1993 | Noda | |
| 5,279,767 | A | 1/1994 | Phan et al. | |
| 5,814,188 | A | 9/1998 | Vinson et al. | |
| 6,416,624 | B1 | 7/2002 | Nielsen et al. | |
| 7,195,771 | B1 | 3/2007 | Hsu et al. | |
| 8,187,419 | B2 | 5/2012 | Chan et al. | |
| 10,794,007 | B2 * | 10/2020 | Vogt | D21H 27/00 |
| 2004/0074622 | A1 | 4/2004 | Liu et al. | |
| 2005/0238700 | A1 * | 10/2005 | Kleinwaechter | A61K 8/0208 424/443 |
| 2005/0271710 | A1 | 12/2005 | Argo et al. | |
| 2006/0163524 | A1 | 7/2006 | Lange et al. | |
| 2006/0243405 | A1 * | 11/2006 | Zwick | D21H 21/22 162/135 |
| 2007/0044930 | A1 | 3/2007 | Vinson et al. | |
| 2007/0071797 | A1 | 3/2007 | Hernandez-Munoa et al. | |
| 2007/0196405 | A1 | 8/2007 | Wilker et al. | |
| 2009/0188637 | A1 * | 7/2009 | Chan | D21H 17/33 162/112 |

(Continued)

FOREIGN PATENT DOCUMENTS

| | | | |
|---|---|---|---|
| CN | 104099809 | A | 10/2014 |
| EP | 08063012 | B1 | 9/1999 |

(Continued)

OTHER PUBLICATIONS

Ghosh, A.K., Fundamentals of Paper Drying—Theory and Application from Industrial Perspective. Evaporation, Condensation and Heat transfer, Sep. 12, 2011, pp. 574-575.

(Continued)

*Primary Examiner* — Jose A Fortuna
(74) *Attorney, Agent, or Firm* — Kimberly-Clark Worldwide, Inc.

(57) ABSTRACT

A soft tissue having a soothing feel and method of making the same is disclosed which contains an aqueous softening composition comprising from about 10 to about 20 weight percent of a cationic softening compound, such as quaternary ammonium compounds and imidazolinium compounds; from about 10 to about 20 weight percent of a polyhydroxy compound having a molecular weight of at least about 1,000 g/mol, and optionally a silicone or glycerin. Examples of the cationic softening compound include tallow- and ester-substituted quaternary ammonium compounds having chloride or methyl sulfate as the anion, and examples of the polyhydroxy compound include polyethylene glycols (PEG) or polypropylene glycols (PPG) having a molecular weight of at least about 1,000 g/mol, such as PEG-1000 and PEG-8000.

20 Claims, No Drawings

(56) References Cited

U.S. PATENT DOCUMENTS

| | | | | |
|---|---|---|---|---|
| 2009/0297781 | A1* | 12/2009 | Huss | B31F 1/07 428/166 |
| 2009/0314444 | A1 | 12/2009 | Sorns et al. | |
| 2010/0155004 | A1 | 6/2010 | Soerens et al. | |
| 2010/0236735 | A1* | 9/2010 | Goulet | D21H 17/34 162/112 |
| 2011/0217345 | A1* | 9/2011 | Huang | C08K 5/05 424/401 |
| 2014/0037701 | A1* | 2/2014 | Mellin | A61K 8/31 424/401 |
| 2014/0037896 | A1* | 2/2014 | Ho-Kleinwaechter | B32B 29/005 428/125 |
| 2015/0159330 | A1 | 6/2015 | Weisman et al. | |
| 2016/0244915 | A1* | 8/2016 | Mohammadi | D21H 19/10 |
| 2017/0009402 | A1* | 1/2017 | Mohammadi | C11D 3/2093 |
| 2018/0094388 | A1* | 4/2018 | Mohammadi | D21H 17/53 |
| 2019/0002747 | A1* | 1/2019 | Salaam-Zayid | C09K 5/06 |
| 2019/0031802 | A1* | 1/2019 | Gu | C08F 224/00 |
| 2019/0071822 | A1* | 3/2019 | Lee | D21H 27/00 |
| 2019/0078262 | A1* | 3/2019 | Vogt | D21H 27/004 |

FOREIGN PATENT DOCUMENTS

| | | | |
|---|---|---|---|
| EP | 1408155 | B1 | 12/2006 |
| JP | 10226986 | A2 | 8/1998 |
| WO | WO9906634 | A1 | 2/1999 |

OTHER PUBLICATIONS

Co-pending U.S. Appl. No. 16/084,280, filed Sep. 12, 2018, by Vogt et al. for "Lotion Treated Through-Air Dried Tissue."

* cited by examiner

TISSUE COMPRISING A SOFTENING COMPOSITION

The present application claims priority to U.S. provisional application No. 62/313,058 filed on Mar. 24, 2016, the whole content of which being incorporated herein by reference for all purposes.

BACKGROUND OF THE DISCLOSURE

Tissue products, and particularly bath and facial tissue products, are often used for wiping and cleaning of the body. When wiping frequently with such products certain users may experience irritation and inflammation. Often the irritation and inflammation is caused in-part by the tissue product having a relatively rough surface.

There have been numerous previous attempts to correct the problem of irritation and inflammation caused by wiping with tissue products. One common approach has been to provide a tissue product which is smoother, softer, or both smoother and softer than previous products. One means of producing such a product involves applying a chemical additive to the product's surface. For example, chemical debonders that interfere with the natural fiber-to-fiber bonding may be added to the tissue product. The reduction in fiber-to-fiber bonding may be used to produce a softer, less harsh, product. Exemplary chemical debonding agents include quaternary ammonium salts such as trimethylcocoammonium chloride, trimethyloleylammonium chloride, dimethyldi(hydrogenated-tallow)ammonium methyl sulfate and trimethylstearylammonium chloride. Mono or diester variations of the before mentioned quaternary ammonium salts have also been taught for use in the manufacture of tissue products.

Others have attempted to produce a soft tissue product by applying lotions comprising one or more oils, such as mineral oil, waxes, such as paraffin, or plant extracts, such as chamomile and aloe vera, to the tissue product. This approach has been applied by, for example, by Krzysik, et al., U.S. Pat. No. 5,885,697 and Warner, et al., U.S. Pat. No. 5,525,345.

Despite these efforts the problem of irritation and inflammation resulting from use of tissue products persists. Accordingly, it is an objective of the present invention to provide a tissue paper product which causes less irritation and inflammation to a user's skin. It is a further objective of this invention to provide a treated tissue paper product having a softening composition disposed thereon, where the tissue product has improved surface properties, such as a reduced coefficient of friction. It is yet a further objective of the present invention to provide an aqueous softening composition that may be easily and effectively applied to a tissue product using a wide variety of methods.

These and other objectives are obtained using the present invention, as will become readily apparent from a reading of the following disclosure.

SUMMARY OF THE DISCLOSURE

It has now been discovered that the softness (measured as coefficient of friction) of a tissue web, and more particularly a creped tissue web, may be met or exceeded without excessive use of softening compositions, such as lotions. More specifically it has been discovered that an aqueous softening composition comprising a cationic softening compound (hereinafter often called a "cationic softener"), such as a quaternary ammonium, and a relatively high molecular weight of polyhydroxy compound, such as a polyethylene glycol having a molecular weight of at least about 1,000 g/mol, may be applied at relatively low add-on levels, such as less than about 12 percent, by weight of the tissue web, and still reduce the tissue's coefficient of friction (COF). In addition to a reduced COF, and despite the relatively modest amount of softening composition added to the web, the resulting tissue product may also provide an improved moisturizing feeling.

Accordingly, in one embodiment the present invention provides a tissue web treated with an aqueous softening composition, the composition comprising a cationic softening compound and a polyhydroxy compound having a molecular weight of at least about 1,000 g/mol. The resulting tissue web is both sufficiently strong to withstand use, such as having a geometric mean tensile (GMT) from about 500 to about 1,500 g/3" and more preferably from about 800 to about 1,000 g/3", and has a low coefficient of friction, such as a COF less than about 300 g, and more preferably less than about 250 g and still more preferably less than about 200 g. The foregoing physical properties may be achieved despite applying less than about 6.0 percent and in certain embodiments less than about 5.0 percent, such as from about 0.5 to about 5.0 percent, by weight of the tissue product, of softening composition to one or both outermost surfaces of the tissue web. This discovery provides the flexibility to produce a tissue product with satisfactory softness at a given tensile strength while reducing the add-on of softening composition.

In another embodiment the present invention provides a tissue product produced by dispersing a furnish to form a fiber slurry; forming a wet tissue web; partially dewatering the wet tissue web; pressing the partially dewatered tissue web to a creping cylinder; drying the tissue web; creping the dried tissue web from the creping cylinder to produce a tissue web; and applying an aqueous softening composition comprising a cationic softening compound and a polyhydroxy compound having a molecular weight of at least about 1,000 g/mol at add on levels of less than about 6.0 dry weight percent, by weight of the tissue web, on at least one surface of the tissue web.

Tissue webs produced by the foregoing process may be subject to additional converting, such as calendering or embossing, and may be combined to form multi-ply tissue products. Thus, in other embodiments the present invention provides a tissue product comprising at least one tissue web having an aqueous softening composition comprising a cationic softening compound and a polyhydroxy compound having a molecular weight of at least about 1,000 g/mol disposed thereon, the tissue product having a basis weight greater than about 25 grams per square meter (gsm), a GMT greater than about 500 g/3" and a COF less than about 300 g, and more preferably less than about 250 g and still more preferably less than about 200 g.

In other embodiments the present invention provides a tissue product comprising at least one tissue web that has been treated with an aqueous softening composition comprising a cationic softening compound and a polyhydroxy compound having a molecular weight of at least about 1,000 g/mol wherein the add on level of the aqueous softening composition is less than about 6.0 dry weight percent, by weight of the tissue web, the tissue product having a GMT greater than about 700 g/3" and a COF from about 100 to about 200 g.

In still other embodiments the invention provides a tissue product comprising at least one tissue web having a first and an opposed second surface, an aqueous softening composition disposed on the first and/or the second surface, the aqueous softening composition comprising (i) water; (ii) a polyhydroxy compound having a molecular weight of at least about 1,000 g/mol, in particular polyethylene glycols and polypropylene glycols having a molecular weight of at least about 1,000 g/mol and (iii) a quaternary ammonium compound or an imidazolinium compound.

In yet other embodiments the present invention provides a tissue product comprising two or more tissue plies, wherein one or more of the outermost surfaces of the tissue product may be treated with a softening composition, each treated tissue surface prepared by adding less than about 6.0 dry weight percent, by weight of the tissue web, of an aqueous softening composition consisting essentially of water, a quaternary ammonium compound, polyethylene glycol having a molecular weight from about 1,000 to about 10,000 g/mol and optionally a silicone or glycerin, or mixtures thereof, the tissue product having a GMT greater than about 700 g/3" and a COF from about 100 to about 200 g.

In other embodiments the present invention provides an aqueous softening composition useful in the manufacture of tissue webs and products, the composition comprising water, a cationic softening compound and a polyhydroxy compound having a molecular weight of at least about 1,000 g/mol and optionally a silicone or glycerin, wherein the mass ratio of water to the polyhydroxy compound is from about 1:0.1 to about 1:10. In a particularly preferred embodiment the water comprises from about 40 to about 80 weight percent, by weight of the softening composition.

In other embodiments the present invention provides an aqueous softening composition useful in the manufacture of tissue webs and products, the composition comprising (a) from about 0.1 to 5.0 weight percent of silicone; (b) from about 10 to about 20 weight percent of a cationic softening compound; (c) from about 10 to about 20 weight percent of a polyhydroxy compound having a molecular weight of at least about 1,000 g/mol; (d) from about 10 to about 30 weight percent glycerin and (e) at least about 25 weight percent water. In a particularly preferred embodiment the foregoing composition components (a)-(d) comprise from 30 to about 75 weight percent of the composition. Generally the foregoing aqueous softening composition is applied to a tissue web at add-on levels from about 0.5 to about 6.0 dry weight percent, based upon the dry weight of the tissue, for improving softness and moisturizing feeling of the tissue web.

Definitions

As used herein the term "add-on" refers to the amount of softening composition, on a dry weight basis, added to the tissue web or product. Add-on may be calculated by determining the dry weight of the softening composition added to the web or product and dividing by the bone dry basis weight of the web or product. For example, if 5.0 grams of softening composition comprising 40 percent solids is added to a tissue web having a bone dry basis weight of 40 gsm, the add-on is 5.0 percent.

As used herein the term "emulsion" refers to a heterogeneous mixture of generally an insoluble liquid comprising an aqueous phase and an organic phase. Generally, for aqueous softening compositions of the present invention, the aqueous phase comprises water, which is used to emulsify the cationic softening compound and the polyhydroxy compound.

As used herein, the term "basis weight" generally refers to the bone dry weight per unit area of a tissue and is generally expressed as grams per square meter (gsm). Basis weight is measured using TAPPI test method T-220. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein, the term "caliper" is the representative thickness of a single sheet (caliper of tissue products comprising two or more plies is the thickness of a single sheet of tissue product comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

As used herein, the term "Coefficient of Friction" (COF) refers to the root mean square of the machine direction (MD) and cross-machine direction (CD) COF measured as described in the Test Methods section below. While the COF may vary depending on the tissue web to be treated, the composition of the softener and the add-on amount, tissue products and webs produced as described herein generally have a COF less than about 300 g, more preferably less than about 250 g and still more preferably less than about 200 g. In certain embodiments inventive tissue products may have a COF from about 100 to about 300 g, more preferably from about 100 to about 200 g and still more preferably from about 150 to about 180 g.

As used herein, the term "sheet bulk" refers to the quotient of the sheet caliper (generally having units of μm) divided by the bone dry basis weight (generally having units of gsm). The resulting sheet bulk is expressed in cubic centimeters per gram (cc/g). While the sheet bulk of the products prepared according to the present invention may vary depending on the method of manufacture, the tissue products generally have a sheet bulk greater than about 5.0 cc/g such as from about 5.0 to about 20.0 cc/g and more preferably from about 8.0 to about 15.0 cc/g and still more preferably from about 10.0 to about 14.0 cc/g.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "slope" refers to slope of the line resulting from plotting tensile versus stretch and is an output of the MTS TestWorks™ in the course of determining the tensile strength as described in the Test Methods section herein. Slope is reported in the units of mass per unit of sample width and is measured as the slope of the least-squares line fitted to the load-corrected strain points falling between a specimen-generated force of 70 to 157 grams (0.687 to 1.540 N) divided by the specimen width. Slopes are generally reported herein as having units of grams force (gf) or kilograms force (kgf).

As used herein, the term "geometric mean slope" (GM Slope) generally refers to the square root of the product of machine direction slope and cross-machine direction slope. GM Slope generally is expressed in units of kilograms (kg).

As used herein, the term "geometric mean tensile" (GMT) refers to the square root of the product of the machine direction tensile strength and the cross-machine direction tensile strength of the web. While the GMT may vary, tissue products prepared according to the present disclosure generally have a GMT greater than about 500 g/3", such as from about 500 to about 1,500 g/3" and more preferably from about 750 to about 1,000 g/3".

As used herein, the term "Stiffness Index" refers to the quotient of the geometric mean tensile slope, defined as the square root of the product of the MD and CD slopes (typically having units of kgf), divided by the geometric mean tensile strength (typically having units of gf).

$$\text{Stiffness Index} = \frac{\sqrt{MD\ \text{Tensile Slope}\ (kgf) \times CD\ \text{Tensile Slope}\ (kgf)}}{GMT\ (gf)} \times 1{,}000$$

While the Stiffness Index may vary tissue products prepared according to the present disclosure generally have a Stiffness Index less than about 20 and more preferably less than about 15, such as from about 10 to about 20 and more preferably from about 10 to about 15.

As used herein, a "tissue product" generally refers to various paper products, such as facial tissue, bath tissue, paper towels, napkins, and the like. Tissue products may comprise one, two, three or more plies. The tissue product may be a web of tissue spirally wound onto a core or may comprise individual folded sheets that may be stacked together.

The term "dry tissue web" as used herein includes both webs which are dried to a moisture content less than the equilibrium moisture content thereof and webs which are at a moisture content in equilibrium with atmospheric moisture.

All percentages, ratios and proportions herein are by weight, unless otherwise specified.

DETAILED DESCRIPTION OF THE DISCLOSURE

It was previously believed that softening agents, such as silicones, glycerin, or waxes, needed to be added at high levels, with greater reductions in tensile strength, to achieve soft tissue products (often measured as low levels of friction). It has now been surprisingly discovered that the add-on of softening composition may be reduced significantly by applying an aqueous softening composition comprising a cationic softening compound and a relatively high molecular weight of polyhydroxy compound to the tissue web.

Thus, the present invention provides a tissue web having a softness that meets or exceeds satisfactory levels without the excess use of softening compositions, such as lotions. The satisfactory level of softness, which may be measured as coefficient of friction (COF), is generally less than about 300 g, and more preferably less than about 250 g and still more preferably less than about 200 g. In certain embodiments inventive tissue products may have a COF from about 100 to about 300 g, more preferably from about 100 to about 200 g and still more preferably from about 150 to about 180 g.

The satisfactory level of softness on at least one surface of the tissue web may be achieved by applying relatively low levels of the aqueous softening composition to the surface of the tissue web, such as less than about 6.0 dry weight percent, by weight of the tissue web, and more preferably about 5.0 percent and still more preferably less than about 4.0 percent, such as from about 0.5 to about 6.0 percent and more preferably from about 1.0 to about 5.0 percent. The foregoing add-on levels not only achieve a relatively low coefficient of friction, such as less than about 300 g, but also result in tissue products with a surprising high degree of strength, such as a GMT greater than about 500 g/3", such as from about 500 to about 1,500 g/3", more preferably from about 700 to about 1,100 g/3" and more preferably from about 800 to about 1,000 g/3".

Tissue webs and products may be manufactured by applying an aqueous softening composition comprising a cationic softening compound and a relatively high molecular weight of polyhydroxy compound to at least one surface of the web. Suitable cationic softening compounds include both quaternary ammonium compounds including, for example, amidoamine quaternary ammonium compounds, diamidoamine quaternary ammonium compounds, ester quaternary ammonium compounds, alkoxy alkyl quaternary ammonium compounds, benzyl quaternary ammonium compounds, alkyl quaternary ammonium compounds, and imidazolinium compounds.

For example, in one embodiment, the softening composition comprises an alkyl quaternary ammonium compound having the general formula:

$$(R1')4\text{-}b\text{-}N+\text{-}(R1'')bX—$$

where R1' is a $C_{1-6}$ alkyl group, R1" is a $C_{14-22}$ alkyl group, b is an integer from 1 to 3 and X— is any suitable counterion such as, acetate, chloride, bromide, methylsulfate, formate, sulfate, nitrate.

In certain preferred embodiments the quaternary ammonium compound is a natural or synthetic tallow where R1" is a $C_{16-18}$ alkyl and more preferably where R1" is straight-chain $C_{18}$ alkyl. In those instances where the quaternary ammonium compound is derived from natural sources, several different types of vegetable oils may be used, such as olive, canola, safflower, or sunflower oil. Suitable quaternary ammonium compounds include, for example, dialkyldimethylammonium salts (e.g., ditallowdimethylammonium chloride, ditallowdimethylammonium methyl sulfate, di(hydrogenated tallow)dimethyl ammonium chloride, etc.) and trialkylmethylammonium salts (e.g., tritallowmethylammonium chloride, tritallowmethylammonium methyl sulfate, tri(hydrogenated tallow)methyl ammonium chloride, etc.), in which R1' are methyl groups and R1" are tallow groups of varying levels of saturation. X— can be any compatible anion such as, acetate, chloride, bromide, methylsulfate, and formate. In a particularly preferred embodiment X— is chloride or methyl sulfate.

In other embodiments the quaternary ammonium compound comprises mono-, di-, or tri-ester quaternary ammonium compounds; di-esterified quaternary ammonium compounds having the general formula:

$$(R1')4\text{-}b\text{-}N+\text{-}(CH_2)n\text{-}Y—(R1''')bX—$$

where Y is —O—(O)C—, or —C(O)—O—, or —NH—C(O)—, or —C(O)—NH—; b is 1 to 3; n is 0 to 4; R1' is a $C_{1-6}$ alkyl group, hydroxyalkyl group, hydrocarbyl or substituted hydrocarbyl group, alkoxylated group, benzyl group, or mixtures thereof; R1''' is a $C_{13-21}$ alkyl group, hydroxyalkyl group, hydrocarbyl or substituted hydrocarbyl group, alkoxylated group, benzyl group, or mixtures thereof; and X is any softener-compatible anion. In a particularly preferred embodiment Y=—O—(O)C—, or —C(O)—O—; b=2; and n=2. In other embodiments R1' is a $C_{1-3}$, alkyl group, with methyl being most preferred. In still other embodiments R1''' is $C_{13-18}$ alkyl and/or alkenyl, more preferably R1''' is straight chain $C_{15-18}$ alkyl and/or alkenyl. Optionally, the R1''' substituent can be derived from vegetable oil sources such as olive, canola, safflower, or sunflower oil. As noted previously, X— can be any compatible anion such as, acetate, chloride, bromide, methylsulfate, formate, and nitrate. Preferably X— is chloride or methyl sulfate.

In one particularly preferred embodiment the cationic softener comprises ester quaternary ammonium compounds such as those marked under the tradename SUNQAT-CEQ90 (Sunjin Chemical Co. Ltd., Ansan, South Korea).

In other embodiments the softening composition may comprise imidazolinium compounds having the general formula:

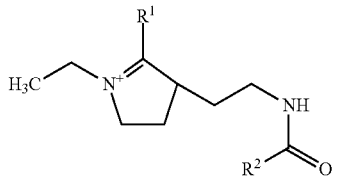

wherein $R^1$ and $R^2$ are each independently a $C_{12-20}$ hydrocarbyl group. Therefore, $R^1$ and $R^2$ can be the same or different. Although not illustrated the imidazolinium compound is typically provided with a compatible anion.

Preferred imidazolinium compounds are those imidazoline derivatives wherein $R^1$ and $R^2$ are independently $C_{12-20}$ alkyl and alkenyl, and more preferably $C_{14-20}$ alkyl. Suitable examples of such imidazoline derivatives include stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconutamido ethyl-2-coconut imidazoline, tallow amido ethyl-2-tallow imidazoline and mixtures of such imidazoline derivatives. More preferred are those imidazoline derivatives wherein $R^1$ and $R^2$ are independently $C_{16-20}$ alkyl (e.g. wherein $R^1$ and $R^2$ are palmityl, stearyl and arachidyl). Most preferred are those imidazoline compounds wherein $R^1$ and $R^2$ are independently $C_{16-18}$ alkyl, i.e., wherein $R^1$ and $R^2$ are each derived from tallow.

Particularly preferred imidazoline-derivatives include cationic oleyl imidazoline materials such as methyl-1-oleylamidoethyl-2-oleylimidazolinium methylsulfate commercially available as Mackernium CD-183 (McIntyre Ltd., University Park, Ill.) and Prosoft TQ-1003 (Solenis LLC, Wilmington, De.) of which cationic portion having the formula:

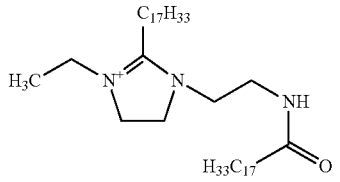

The cationic softening compound may be incorporated in the softening composition of the present invention in varying amounts. For example, in one embodiment the cationic softening compound may comprise from about 5.0 to about 30 weight percent, by weight of the softening composition, more preferably from about 8.0 to about 20 weight percent and still more preferably from about 10 to about 15 weight percent.

In addition to a cationic softening compound, the softening composition contains a polyhydroxy compound and more preferably a relatively high molecule weight polyhydroxy compound, such as a polyhydroxy compound having a molecular weight of at least about 1,000 g/mol. A particularly preferred polyhydroxy compound has a molecular weight of greater than about 4,000 g/mol. As such the molecule weight of polyhydroxy compound may range from about 1,000 to about 12,000 g/mol and more preferably from about 1,500 to about 10,000 g/mol and still more preferably from about 6,000 to about 8,000 g/mol.

Examples of polyhydroxy compounds useful in the present invention include, but are not limited to, polyethylene glycols and polypropylene glycols having a molecular weight of at least about 1,000 g/mol and more preferably greater than about 2,000 g/mol and still more preferably greater than about 4,000 g/mol and more preferably greater than about 6,000 g/mol, such as from about 1,000 to about 12,000 g/mol, and more preferably from about 4,000 to about 10,000 g/mol and still more preferably from about 6,000 to about 8,000 g/mol. In a particularly preferred embodiment, the softening composition comprises a polyethylene glycol having a molecular weight of from about 1,000 to about 10,000 g/mol and more preferably from about 6,000 to about 8,000 g/mol.

In certain embodiments the softening composition may comprise two or more different polyhydroxy compounds, such as polyethylene glycol of different molecular weights. Thus, in one particularly preferred embodiment the softening composition comprises a first polyethylene glycol having a molecular weight from about 1,000 to about 6,000 g/mol and a second polyethylene glycol having a molecular weight from about 8,000 to about 10,000 g/mol.

The polyhydroxy compound may be incorporated in the softening composition of the present invention in varying amounts. In one embodiment the polyhydroxy compound comprises from about 5.0 to about 30 weight percent, by weight of the softening composition, more preferably from about 8.0 to about 20 weight percent and still more preferably from about 10 to about 15 weight percent.

The relative ratio of the cationic softener to the polyhydroxy compound may be varied to achieve the desired tissue product properties or to accommodate different methods of application. For example, in certain embodiments, the weight ratio of the cationic softener to the polyhydroxy compound ranges from about 1:0.1 to about 0.1:1, and more preferably from about 1:0.3 to about 0.3:1 and still more preferably from about 1:0.7 to about 0.7:1, although this ratio will vary depending upon the molecular weight of the particular cationic softener and polyhydroxy compound used.

The foregoing softening composition is generally applied to one or two outermost surfaces of a dry tissue web and more preferably a creped tissue web. As such the softening composition is generally applied as an aqueous solution comprising a cationic softening compound and polyhydroxy compound. The aqueous softening solution is generally prepared as a water-based emulsion and then applied to the dry tissue web. It is believed in this manner that tactile softness of the tissue sheet and resulting tissue products may be improved due to presence of the softening composition on the surface of the tissue product. Thus, the aqueous softening composition generally comprises from about 25 to about 75 weight percent, by weight of the composition, water and more preferably from about 30 to about 60 percent and still more preferably from about 40 to about 50 percent.

In other embodiments the amount of water in the aqueous softening composition may be varied depending upon the amount of the polyhydroxy compound. For example the mass ratio of water to the polyhydroxy compound may be about 1:0.1 to about 1:10 and more preferably from about 1:0.2 to about 1:5 and still more preferably from about 1:0.5 to about 1:2. In a particularly preferred embodiment the water comprises from about 40 to about 80 weight percent, by weight of the softening composition, and the polyhydroxy compound comprises from about 10 to about 15 weight percent.

To further enhance softening of the tissue sheet and resulting tissue products the softening composition may also include a silicone, also referred to herein as a polysiloxane or as a siloxane. A large variety of silicones are available that are capable of enhancing the tactile properties of the finished tissue sheet. Any silicone capable of enhancing the tactile softness of the tissue sheet is suitable for incorporation in this manner so long as solutions or emulsions of the cationic softener and silicone are compatible, that is when mixed they do not form gels, precipitates or other physical defects that would preclude application to the tissue sheet.

Examples of suitable silicones include but are not limited to linear polydiallyl polysiloxanes such as the DC-200 fluid series available from Dow Corning, Inc., Midland, Mich., as well as the organo-reactive polydimethyl siloxanes such as the preferred amino functional polydimethyl siloxanes. Examples of suitable silicones include those described in U.S. Pat. Nos. 6,054,020 and 6,432,270, the disclosures of which are incorporated herein by reference in a manner consistent with the instant disclosure. Suitable silicones generally have the formula:

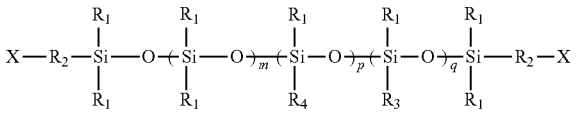

wherein:

X is hydrogen, hydroxy, amino, $C_{1-8}$ straight chain, branched, cyclic, unsubstituted or hydrophilically substituted alkyl or alkoxyl radical;

m=20-100,000;

p=1-5000;

q=0-5000;

$R_1$=a $C_{1-6}$, straight chain, branched or cyclic alkyl radical;

$R_2$=a $C_{1-10}$ straight chain or branched, substituted or unsubstituted alkylene diradical;

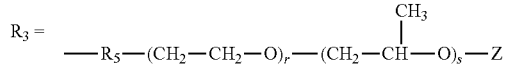

wherein:

$R_5$ is an unsubstituted or a hydrophilically substituted $C_{1-10}$ alkylene diradical;

r=1-10,000;

s=0-10,000; and

Z=hydrogen, $C_{1-24}$ alkyl group, or a G-group, where G is selected from the following: —$R_6COOR_7$; —$CONR_8R_9$; —$SO_3R_8$; and PO $R_8R_9$, where $R_6$ is a substituted or unsubstituted $C_{1-6}$ alkylene diradical; $R_7$, $R_8$, and $R_9$ are independently a hydrogen radical or a substituted or unsubstituted $C_{1-8}$ alkyl radical;

and

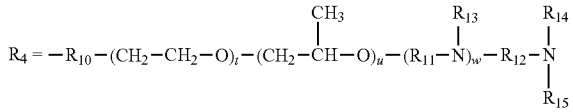

wherein:

$R_{10}$, $R_{11}$, and $R_{12}$ are independently an unsubstituted or a hydrophilically substituted $C_{1-8}$ alkylene diradical;

t=0-10,000;

u=0-10,000;

w=0-10,000; and $R_{13}$, $R_{14}$ and $R_{15}$ are independently a hydrogen radical, an unsubstituted or a hydroxyl, carboxyl or other functionally substituted $C_{1-10}$ straight chain, branched, or cyclic alkyl radical.

When incorporated in the softening composition, silicone may be added at varying amounts. In one embodiment the softening composition comprises at least about 0.1 weight percent, by weight of the softening composition, silicone, such as from about 0.1 to about 6.0 dry weight percent, and more preferably from about 0.1 to about 5.0 weight percent and still more preferably from about 0.5 to about 3.0 weight percent.

While silicone may be incorporated in the softening composition of the present invention, its presence is not necessary. Surprisingly, in certain embodiments, a soft tissue product, such as a tissue product having a COF less than about 200 g, such as from about 100 to about 200 g, may be prepared with the addition of little or no silicone. For example, the foregoing properties may be achieved by applying an aqueous softening composition comprising less than about 0.5 weight percent silicone, such as from about 0 to about 0.5 weight percent silicone.

In still other embodiments, the softening composition may optionally include glycerin. When incorporated in the softening composition, the amount of glycerin in the softening composition can be from about 5.0 to about 40 weight percent, more particularly from about 10 to about 30 weight percent, and still more particularly from about 15 to about 20 weight percent.

Thus, in certain embodiments the softening composition of the present invention may consist essentially of water, a cationic softening compound, such as a quaternary ammonium compound, a polyhydroxy compound having a molecular weight of at least about 1,000 g/mol and optionally a silicone or glycerin, or mixtures thereof. In other embodiments the softening composition may consist essentially of water, a quaternary ammonium compound, a polyhydroxy compound having a molecular weight of at least about 1,000 g/mol, a silicone and glycerin.

Other chemicals commonly used in papermaking can be added to the softening composition described herein, or to the papermaking furnish so long as they do not significantly and adversely affect important tissue product properties, such as strength or absorbency of the tissue product, or negatively affect the softening provided by the softening compositions of the present invention. For example, dry strength additives such as starch or carboxymethyl cellulose may be added to the furnish to improve the tensile strength of the tissue products. In other embodiments wet strength resins, such as polyamide-epichlorohydrin resins may be added to the furnish to improve the tensile strength of the tissue product when wet. In still other embodiments a temporary wet strength agent may be added to the furnish, such as modified starch and more particularly cationic starches.

Other additives may include humectants and skin protectants. Suitable humectants include lactic acid and its salts, sugars, ethoxylated glycerin, ethoxylated lanolin, corn syrup, hydrolyzed starch hydrolysate, urea, and sorbitol. Suitable skin protectants include allantoin, kaolin, zinc oxide, aloe vera, vitamin E, petrolatum and lanolin. Again, the foregoing additives are generally complementary to the softening compositions of the present invention and generally do not significantly and adversely affect important tissue product properties, such as strength or absorbency of the tissue product, or negatively affect the softening provided by the softening compositions of the present invention.

The softening composition of the present invention may be added to the tissue web at any point after the web has been formed and at least partially dewatered. In a particularly preferred embodiment the softening composition is applied to the web after it has been dried to final dryness, such as a moisture content less than about 6.0 percent (by weight of the tissue web) and more preferably less than about 5.0 percent. For example, the softening composition may be applied after the drying section of the tissue machine where the tissue sheet has a consistency of from about 90 to about 100 percent. The softening composition may also be applied via a secondary post treatment process where the tissue sheet has a consistency of from about 90 to about 100 percent.

The method by which the softening composition is applied to the tissue sheet may be accomplished by any method known in the art. For example, in one embodiment the composition may be applied by contact printing methods such as gravure, offset gravure, flexographic printing and the like. The contact printing methods often enable topical application of the composition to the tissue sheet. In other embodiments the softening composition may be applied to the tissue web by non-contact printing methods such as ink jet printing, digital printing of any kind, and the like.

In still other embodiments the softening composition may be sprayed onto the tissue sheet. For example, spray nozzles may be mounted over a moving tissue sheet to apply a desired dose of a solution to the tissue sheet. Nebulizers may also be used to apply a light mist to a surface of a tissue sheet. In other embodiments the softening composition may be applied to a moving belt or fabric by spray or other means and the belt or fabric may in-turn contact the tissue sheet to apply the softening composition to the tissue web.

In still other embodiments the softening composition may be applied by coating onto the tissue sheet by slot coating, blade coating, air knife coating, short dwell coating, cast coating, and the like.

Preferred methods of application include gravure printing, flexographic printing, spraying and topical application using a WEKO fluid application system (commercially available from Weitmann & Konrad GmbH & Co. Leinfelden-Echterdingen, Germany). A particularly preferred method of application is rotogravure printing such as described in U.S. Pat. No. 5,665,426, the contents of which are incorporated by reference in a manner consistent with the present disclosure.

In one embodiment the softening composition may be applied by an indirect application process where the softening composition is applied to the web via a transfer/applicator roll. For example, the web to be treated may be threaded from an unwind roll through a nip between the transfer/applicator roll and a backing roll. The softening composition is added to a second nip created between a Mayer rod and the transfer/applicator roll. Mayer rods are well known in the art and are provided in a number of different configurations that allow different volumes of fluid to be put onto the transfer/applicator roll. The softening composition applied to the transfer/applicator roll by the Mayer rod is subsequently disposed on the web.

The softening composition may be applied to only a single surface of the tissue web or may be applied to both the upper and opposed lower surfaces of the web. The add-on amount of the softening composition on each surface can be from about 0.5 to about 6.0 dry weight percent based on the weight of the tissue, more specifically from about 1.0 to about 5.0 dry weight percent, and still more specifically from about 2.0 to about 4.5 dry weight percent.

Further, it is generally desirable after formation and drying of the web to prevent significant rewetting of the tissue sheet or to negatively affect the web's tensile strength by topically applying excessive amounts of aqueous solution. Thus, in a preferred embodiment, the add-on amount of softening composition on one surface is less than about 6.0 dry weight percent and the addition of the softening composition results in a geometric mean tensile strength decrease of less than about 30 percent, as measured in the treated tissue sheet compared to the untreated tissue sheet.

Surprisingly, the instant softening composition may be added at relatively low levels, such as less than about 6.0 dry weight percent, such as from about 0.5 to about 6.0 dry weight percent, on one surface, and still provide a significant softening effect. For example, the table below compares the softening effect (measured as COF) provided by the inventive softening composition and conventional softening compositions.

TABLE 1

| Softener Composition | Inventive Cationic softener, polyhydroxy compound, silicone, glycerin | Inventive Cationic softener, polyhydroxy compound, silicone, glycerin | Conventional Silicone | Conventional Glycerin, sorbitol | Conventional Paraffin wax, mineral oil |
|---|---|---|---|---|---|
| Softener Add-on (wt %) | 3.8 | 2.0 | 4 | 18 | 11 |
| MD Coefficient of Friction (g) | 143 | 154 | 174 | 195 | 205 |
| CD Coefficient of Friction (g) | 162 | 182 | 239 | 247 | 227 |

Not only does the instant softening composition provided relatively large beneficial decreases in coefficient of friction, but its addition only moderately decreases tensile strength. For example, the softening composition may be applied at levels up to about 6.0 dry weight percent on one surface of the tissue web, based upon the weight of the tissue web, and only decrease the tensile (measured as GMT) strength of the tissue web less than about 10 percent and more preferably less than about 8.0 percent, such as from about 4.0 to about 10 percent.

Although such low levels of add-on of softening composition had not been previously believed to be suitable for producing soft tissue, it has now been discovered that treating a tissue web with a softening composition comprising both a cationic softening compound and a relatively high molecular weight of polyhydroxy compound are able to produce tissues having a COF less than about 200 g at a GMT greater than about 700 g/3".

TABLE 2

| Softener | Softener Add-on (wt %) | GMT (g/3") | GM Slope (kgf) | Stiffness Index | MD COF (g) | CD COF (g) | COF (g) |
|---|---|---|---|---|---|---|---|
| Silicone | 4.0 | 732 | 12.3 | 16.8 | 174 | 239 | 204 |
| Glycerin, sorbitol | 18.0 | 645 | 12.5 | 19.4 | 195 | 247 | 219 |
| Paraffin wax, mineral oil | 11.0 | 890 | 13.8 | 15.5 | 205 | 227 | 216 |
| Cationic softener, polyhydroxy compound, silicone, glycerin | 3.8 | 780 | 10.6 | 13.6 | 143 | 162 | 152 |

Thus, it has now been demonstrated that the add-on of the aqueous softening composition may be reduced to less than about 6.0 percent on one surface of the tissue web, by weight of the tissue web, without negatively effecting important tissue product properties. As such, in certain embodiments, tissue products prepared according to the present invention generally have a GMT from about 500 to about 1,500 g/3" and more preferably from about 750 to about 1,000 g/3", and a COF from about 150 to about 200 g and a Stiffness Index less than about 20, such as from about 10 to about 20 and more preferably from about 10 to about 15.

In addition to providing surprisingly low coefficients of friction at a given add-on level, the instant softening compositions provide the additional benefit that they may be prepared as water-based emulsions that do not require further heating prior to use. Thus, in one embodiment, the softening composition is prepared and applied to the tissue as an emulsion comprising at least about 50 weight percent water (as a percent of the total weight of the emulsion). In other embodiments softening composition emulsions of the present invention may comprise from about 50 to about 90 weight percent of water, preferably 55 to 80 weight percent, and more preferably 60 to 75 weight percent.

The emulsion generally is not heated prior to application to the web and as such is generally applied at a temperature less than about 100° C., and more preferably less than about 50° C., such as from about 15 to about 100° C. and more preferably from about 20 to about 50° C. and still more preferably from about 20 to about 30° C.

While the emulsion is preferably not heated prior to application, preparation of the emulsion may require heating of one or more of the components. For example, the emulsion may be prepared by heating the polyhydroxy compound to a temperature from about 50 to about 70° C., and then adding the cationic softener and mixing, followed by the addition of water and further mixing to form the emulsion. Upon mixing, the emulsion generally has a viscosity from about 50 to about 300 cPs, such as from about 50 to about 250 cPs and more preferably from about 100 to about 200 cPs. In another embodiment, the emulsion has a viscosity of at least about 30 cPs.

Without being bound by any particular theory, it is believed that premixing the cationic softening compound and the polyhydroxy compound prior to application to the tissue web enhances the retention of the polyhydroxy compound on the surface of the web and enhances surface softness. Thus, in certain embodiments, a high percentage of the polyhydroxy compound is retained on the surface of the web, such as at least about 40 percent and more preferably at least about 50 percent and still more preferably at least about 60 percent, such as from about 40 to about 95 percent. In a particularly preferred embodiment from about 70 to about 95 percent of the polyhydroxy compound is retained on the surface of the web.

Not only is a relatively high percentage of the polyhydroxy compound initially retained on the surface of the web, a significant amount of the polyhydroxy compound may remain on the surface well after formation of the resulting tissue product. While not wishing to be bound by theory, it is believed that the addition of both a cationic softening compound and a polyhydroxy compound and particularly a relatively high molecular weight, e.g., at least about 1,000 g/mol, polyhydroxy compound results in increased retention on the fiber surface and less z-directional migration. These relatively high molecular weights of polyhydroxy compound have relatively low glass transition temperatures, such as from about −20 to about −5° C., and are good film forming agents, hence sheet stiffness and therefore tissue sheet softness is not negatively impacted by their presence. As such, tissue webs and products having the foregoing softening composition applied to at least one surface generally have equal or greater softness at higher tensile strength and lower add-on levels compared to other lotion treated tissue webs and products.

Thus, in one embodiment, the present invention provides a multi-ply tissue product comprising first and second outer plies and a third middle ply disposed between the first and second outer plies where the first and second outer plies comprise a tissue web comprising the softening composition of the present invention disposed on at least one surface, and the third middle ply is manufactured without the addition of softening composition. Despite the middle ply being manufactured without the addition of softening composition certain components of the softening composition applied to the outer plies may migrate through the outer plies to the middle ply. According, in certain embodiments from about 5.0 to about 20 weight percent of the total cationic softener found in the tissue product may be found in the middle layer and more preferably from about 5.0 to about 15 weight percent. Conversely, the middle layer is preferably substantially free from high molecular weights of polyhydroxy.

Should the disclosure of any patents, patent applications, and publications which are incorporated herein by reference conflict with the description of the present application to the extent that it may render a term unclear, the present description shall take precedence.

Test Methods

Basis Weight

The basis weight was measured as bone dry basis weight. Basis weight of the tissue sheet specimens may be determined using the TAPPI T410 procedure or a modified equivalent such as: Tissue samples are conditioned at 23±1° C. and 50±2 percent relative humidity for a minimum of 4 hours. After conditioning, a stack of 16 3-inch by 3-inch samples are cut using a die press and associated die. This represents a tissue sheet sample area of 144 int or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram using an analytical balance. The basis weight in grams per square meter (gsm) is calculated using the following equation: Basis weight=stack weight in grams/0.0929.

Tensile

Samples for tensile strength testing are prepared by cutting a 3 inches (76.2 mm) by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

Coefficient of Friction

Coefficient of friction ("COF") was determined using an I.D.M. instrument P/L. Samples were conditioned at 23±1° C. and 50±2 percent relative humidity for a minimum of 4 hours prior to testing. Place the 305 mm (12 inch) basesheet material or finished tissue specimen, test side up, on the testing bed. Clasp the specimen in the clamp or line up the right side of the specimen over the double-sided tape and press down to attach the specimen to the tape. Place the COF testing sled (foam side down) on top of the 120 mm tissue specimen stack (test side down). Wrap the front (slit) end of one sheet up onto the double-sided tape. Test specimens should be uncontaminated and have their test sides facing each other. Position the sled pin in the load cell mount. Place the anti-skid guide over the sled; make sure that the sled is centered under the anti-skid guide. Use the 200 gram sled for all materials. The sample was then placed and secured in the test sled. All COF units are in grams. Specific test parameters were as follows—Sled size: 2.5"×2.5"×0.25", Sled weight: 200±5 g, Speed: 150±30 mm.

Lotion Migration

Lotion add-on in tissue samples (3-ply tissue product) was determined using accelerated solvent extraction (ASE). Determination of individual components contained within each ply was accomplished using liquid chromatography (LC).

Samples were provided with the top, middle and bottom plies separated. ASE 350 extractor using isopropyl:water mixture (95:5) was used to extract the lotion from each ply sample. Samples were analyzed in triplicate and a single ply sheet of the tissue (0.6 to 1 g) was used for each extraction. Sample was placed into a 22 mL sample extraction cell with a filter placed at the bottom of the cell. The operational settings for each solvent specified below were entered.

| | | | |
|---|---|---|---|
| Solvent: Isopropanol: Water | 100% | Pressure: | 1500 psi |
| Temperature: | 100° C. | Preheat Time: | 0 min |
| Heating Time: | 5 min | Static Time: | 5 min |
| Flush Volume: | 80% | Purge Time: | 300 sec |
| Static Cycle: | 2 | | |

At the end of the extraction cycle, the previously weighed collection vial was placed in a warm water bath (80° C.) and evaporated to dryness for 90 minutes under a gentle stream of air using the Zymark TurboTax LV Evaporator. The vial was reweighed and the amount of extract calculated.

The following chromatographic conditions were used for determination of glycerin, cationic softener and polyethylene glycol:

Mobile phase—(90:10) ethyl Alcohol (IPA):water with 0.1% acetic acid overall

Flow rate: 0.6 mL/min.

Column: Phenomenex Luna NH2, 5 micron, 15 cm×4.6 mm 90:10 (IPA:water) for standard dilution and sample analysis ELS detection: 40° C. nebulizer temperature, 30° C. evaporation temperature, nitrogen flow at 1.60 SLM Run time: 7 minutes Column Temperature: ambient Injection volume: 2 μL Preparation of Standard:

Separately weighed 81.20 mg glycerin into 50-mL flask, 52.9 mg PEG 8000 into 100-mL flask, and 49.2 CEQ 90 into 50-mL flask. Approximately 25 mL (90:10) IPA:water was added into each flask and the contents were sonicated for 10 minutes. 5.0 mL glycerin standard stock, 10.0 mL CEQ 90 standard stock, and 5.0 mL PEG 8000 standard stock were taken with pipet and introduced into 25-mL flask and diluted to volume with (90:10) IPA:water. The mixed standard was serially diluted to create a set of standards for a calibration curve. All standards were filtered prior to injection.

Preparation of Carton Samples:

Depending on the weight of extract in vial, either 10 mL up to 50 mL of (90:10) IPA:water was added. Any sample with a weight of less than 10 mg was extracted and diluted with 10 mL diluent. The contents were sonicated for 10 minutes or until all of the extract is solubilized. All samples were filtered with nylon 0.45 micron syringe filter.

EXAMPLES

A multi-ply wet pressed tissue product was produced from eucalyptus hardwood kraft (EHWK), and northern softwood kraft (NSWK). The stock solutions were pumped to a headbox after dilution to 0.2 percent consistency to form a blended tissue web comprising 70 percent EHWK and 30 percent NSWK. The target basis weight for all codes was about 45 gsm. The target tensile strength for all codes was a GMT of about 1,000 g/3". Refining and wet strength resin (PAE resin) were used to control the target geometric mean tensile strength of the tissue web.

The formed web was pressed against a Yankee dryer and adhered thereto using a mixture of Baysize (Mineral oil), water and Kymene® (PAE resin). The dried web was subsequently removed from the Yankee dryer by creping. The crepe ratio was set at 1.25-1.35.

The creped single ply tissue web was then subjected to topical treatment with a softening composition. The softening compositions were applied by Gravure coater. To prepare the inventive softening compositions the cationic softening compound was first mixed with a small amount of water using a high shear mixer. After mixing, the polyhydroxy compound was added along with either silicone or glycerin, as specified in the table below, followed by further high shear mixing. Viscosity was measured by Brookfield DV-II ultra-type (Brookfield Engineering Laboratories) at 25° C. The silicone was UTA6014 (Wacker Chemical Corp., Adrian, Mich.) 6.0 percent silicone and 56 percent water. The softener was CEQ90 (Sunjin Chemical Co. Ltd).

TABLE 3

| | Softener Composition M | Softener Composition U |
|---|---|---|
| Silicone (wt %) | 0 | 30 |
| Softener (wt %) | 15 | 14 |
| PEG-8000 (wt %) | 12 | 0 |
| PEG-1,000 (wt %) | 0 | 7 |
| Glycerin (wt %) | 20 | 0 |
| Water (wt %) | 53 | 49 |
| Initial viscosity, cPs | 157 | 140 |

To produce multi-ply products, the base sheets, were plied together. The resulting three-ply tissue products were tested and exhibited the properties as shown in the tables below.

TABLE 4

| Sample | Softener Composition | Softener Composition Add-on (g per $m^2$ of tissue) | Softener Composition Add-on (wt %) | Basis Weight (gsm) | GMT (g/3") | GM Slope (kgf) | Stiffness Index |
|---|---|---|---|---|---|---|---|
| Inventive 1 | M | 1.64 | 3.8 | 43.5 | 780 | 10.6 | 13.6 |
| Inventive 2 | U | 0.88 | 2.0 | 43.5 | 798 | 10.9 | 14.1 |

TABLE 5

| Sample | Softener Composition | Softener Composition Add-on (wt %) | MD COF (g) | CD COF (g) | COF (g) |
|---|---|---|---|---|---|
| Inventive 1 | M | 3.8 | 143 | 162 | 152 |
| Inventive 2 | U | 2.0 | 154 | 182 | 167 |

The per ply distribution of softening composition topically applied to the surface of the two outer plies of a 3-ply tissue product was determined using accelerated solvent extraction (ASE). Determination of individual components contained within each ply was accomplished using liquid chromatography (LC).

The weight percentage of softening composition components—glycerin, cationic softener and PEG 8000- were measured at various intervals after treatment: Day 1 ("D1"), 1 Week ("1 w"), 2 Week ("2 w"), 1 month ("1 m"), and 3 months ("3 m"). The results of the analysis are summarized in Tables 6-9 below. The results show that although the amount of overall softening composition in the middle layer generally increases with increasing time, extent of the increase in the amount of specific component differs depending on the nature of each component.

TABLE 6

Migration of Glycerin

| Ply | D1 (wt %) | 1w (wt %) | 2w (wt %) | 1m (wt %) | 3m (wt %) |
|---|---|---|---|---|---|
| Top | 22.1 | 15.4 | 14.8 | 15.0 | 22.2 |
| Middle | 66.7 | 64.6 | 70.5 | 69.8 | 63.0 |
| Bottom | 11.2 | 19.9 | 14.8 | 15.2 | 14.8 |

TABLE 7

Migration of Cationic Softener

| Ply | D1 (wt %) | 1w (wt %) | 2w (wt %) | 1m (wt %) | 3m (wt %) |
|---|---|---|---|---|---|
| Top | 42.9 | 53.5 | 45.8 | 47.7 | 39.1 |
| Middle | 0.0 | 4.7 | 8.3 | 7.8 | 13.3 |
| Bottom | 57.1 | 41.8 | 45.9 | 44.5 | 47.6 |

TABLE 8

Migration of PEG 8000

| Ply | D1 (wt %) | 1w (wt %) | 2w (wt %) | 1m (wt %) | 3m (wt %) |
|---|---|---|---|---|---|
| Top | 42.0 | 55.6 | 48.7 | 52.0 | 42.8 |
| Middle | 0.0 | 0.0 | 0.0 | 0.0 | 0.0 |
| Bottom | 58.0 | 44.4 | 51.3 | 48.0 | 57.2 |

TABLE 9

Migration of Softener Composition

| Ply | D1 (wt %) | 1w (wt %) | 2w (wt %) | 1m (wt %) | 3m (wt %) |
|---|---|---|---|---|---|
| Top | 47.9 | 50.5 | 42.5 | 46.7 | 38.2 |
| Middle | 9.5 | 11.1 | 10.6 | 11.6 | 16.2 |
| Bottom | 42.6 | 38.4 | 46.9 | 41.8 | 45.6 |

While various softening compositions, and tissue webs and products treated therewith, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the following embodiments.

In a first embodiment the present invention provides a treated tissue product comprising a tissue web having a first and an opposed second surface, an aqueous softening composition disposed on the first and/or the second surface, the softening composition comprising (i) a polyhydroxy compound having a molecular weight of at least about 1,000 g/mol and (ii) a cationic softener compound.

In a second embodiment the present invention provides the treated tissue product of the first embodiment having a COF less than about 200 g.

In a third embodiment the present invention provides the treated tissue product of the first or the second embodiments having a COF from about 150 to about 180 g, a GMT from about 500 to about 1,500 g/3" and a Stiffness Index less than about 15.

In a fourth embodiment the present invention provides the treated tissue product of any one of the first through third embodiments wherein the cationic softener compound selected from the group consisting of amidoamine quaternary ammonium compounds, diamidoamine quaternary ammonium compounds, ester quaternary ammonium compounds, alkoxy alkyl quaternary ammonium compounds, benzyl quaternary ammonium compounds, alkyl quaternary ammonium compounds and imidazolinium compounds.

In a fifth embodiment the present invention provides the treated tissue product of any one of the first through fourth embodiments wherein the softening composition further comprises a silicone, glycerin, or mixtures thereof.

In a sixth embodiment the present invention provides the treated tissue product of any one of the first through fifth embodiments wherein the softening composition comprises less than about 10 dry weight percent, based upon the dry weight of the tissue product.

In a seventh embodiment the present invention provides the treated tissue product of any one of the first through sixth embodiments wherein the softening composition comprises from about 0.5 to about 5.0 dry weight percent, based upon the dry weight of the tissue product.

In an eighth embodiment the present invention provides the treated tissue product of any one of the first through seventh embodiments wherein the softening composition comprises from about 10 to about 20 weight percent of a cationic softening compound and from about 10 to about 20 weight percent of a polyhydroxy compound.

In a ninth embodiment the present invention provides the treated tissue product of any one of the first through eighth embodiments wherein the softening composition comprises from about 40 to about 75 weight percent water and the ratio of water to the polyhydroxy compound, on a weight basis, is from about 1:0.1 to about 1:10.

We claim:

1. A treated tissue product comprising a tissue web having a first and an opposed second surface, an aqueous softening composition disposed on the first and/or the second surface, the softening composition comprising (i) from about 10 to 20 weight percent of a polyhydroxy compound selected from the group consisting of polyethylene glycols and polypropylene glycols having a molecular weight of at least about 1,000 g/mol (ii) from about 10 to about 20 weight percent of a cationic softener compound selected from the group consisting of amidoamine quaternary ammonium compounds, diamidoamine quaternary ammonium compounds, ester quaternary ammonium compounds, alkoxy alkyl quaternary ammonium compounds, benzyl quaternary ammonium compounds, alkyl quaternary ammonium compounds and imidazolinium compounds, and (iii) from about 40 to about 75 weight percent water.

2. The treated tissue product of claim 1 having a Coefficient of Friction (COF) less than about 200 g and a Geometric Mean Tensile (GMT) from about 500 to about 1,500 g/3".

3. The treated tissue of claim 2 having a COF from about 150 to about 180 g and a Stiffness Index less than about 15.

4. The treated tissue product of claim 1 wherein the softening composition further comprises a silicone or a glycerin, or mixtures thereof.

5. The treated tissue product of claim 1 wherein the softening composition comprises less than about 10 dry weight percent, based upon the dry weight of the tissue product.

6. The treated tissue product of claim 1 wherein the weight ratio of cationic softener to polyhydroxy compound are from about 1:0.7 to about 0.7:1.

7. The treated tissue product of claim 1 wherein the polyhydroxy compound is a polyethylene glycol having a molecular weight from about 4,000 to about 10,000 g/mol and the weight ratio of water to polyhydroxy compound are from about 1:02 to about 1:5.

8. The treated tissue product of claim 1 wherein the polyhydroxy compound has a molecular weight from about 1,000 to about 10,000 g/mol.

9. The treated tissue product of claim 1 comprising from about 0.1 to about 10 dry weight percent silicone and from about 10 to about 40 weight percent glycerin.

10. The treated tissue product of claim 1 wherein the softening composition comprises from about 10 to about 15 weight percent polyhydroxy compound.

11. The treated tissue product of claim 10 wherein the polyhydroxy compound has a molecular weight from about 6,000 to about 8,000 g/mol and wherein the weight ratio of cationic softener to polyhydroxy compound is from about 1:0.7 to about 0.7:1.

12. A treated tissue product comprising a tissue web having a first and an opposed second surface, an aqueous softening composition disposed on the first and/or the second surface, the softening composition comprising:

a. from about 10 to about 20 weight percent of a cationic softening compound selected from the group consisting of amidoamine quaternary ammonium compounds, diamidoamine quaternary ammonium compounds, ester quaternary ammonium compounds, alkoxy alkyl quaternary ammonium compounds, benzyl quaternary ammonium compounds, alkyl quaternary ammonium compounds and imidazolinium compounds;

b. from about 10 to 20 weight percent of a polyhydroxy compound selected from the group consisting of polyethylene glycols and polypropylene glycols having a molecular weight of at least about 1,000 g/mol;

c. from about 60 to about 80 weight percent water; and d. optionally a silicone or glycerin, wherein the treated tissue product has a Coefficient of Friction (COF) less than about 200 g.

13. The treated tissue product of claim 12 having a Geometric Mean Tensile (GMT) from about 500 to about 1,500 g/3" and a Stiffness Index less than about 15.

14. The treated tissue product of claim 12 wherein the softening composition comprises less than about 10 dry weight percent, based upon the dry weight of the tissue product.

15. The treated tissue product of claim 12 wherein the softening composition comprises a polyethylene glycol having a molecular weight from 1,000 to about 10,000 g/mol.

16. A method of manufacturing a soft tissue product comprising the steps of:

a. forming an aqueous softening composition comprising (i) from about 10 to 20 weight percent of a polyhydroxy compound selected from the group consisting of polyethylene glycols and polypropylene glycols and having a molecular weight from 1,000 to about 10,000 g/mol (ii) from about 10 to about 20 weight percent of a cationic softener compound selected from the group consisting of amidoamine quaternary ammonium compounds, diamidoamine quaternary ammonium compounds, ester quaternary ammonium compounds, alkoxy alkyl quaternary ammonium compounds, benzyl quaternary ammonium compounds, alkyl quaternary ammonium compounds and imidazolinium compounds, (iii) from about 40 to about 75 weight percent water, and optionally a silicone or glycerin;

b. providing a tissue web having a first and an opposed second surface; and c. applying the aqueous softening composition to at least the first surface of the tissue web, wherein the aqueous softening composition has a temperature less than about 100° C.

17. The method of claim 16 wherein the tissue web is a dry tissue web and the step of applying is carried out by slot coating, gravure printing, flexographic printing or spraying.

18. The method of claim 16 wherein the aqueous softening composition has a temperature from about 20° C. to about 30° C.

19. The method of claim 16 wherein the softening composition comprises from about 30 to about 70 weight percent water and has a viscosity from about 50 cPs to about 300 cPs.

20. The method of claim 16 wherein the softening composition comprises less than about 5.0 percent, by weight, silicone.

* * * * *